United States Patent [19]

Fujie et al.

[11] 4,194,384

[45] Mar. 25, 1980

[54] METHOD OF MANUFACTURING HEAT-TRANSFER WALL FOR VAPOR CONDENSATION

[75] Inventors: Kunio Fujie, Tokyo; Wataru Nakayama; Heikichi Kuwahara, both of Kashiwa; Takahiro Daikoku, Ibaraki; Kimio Kakizaki, Hitachi, all of Japan

[73] Assignees: Hitachi, Ltd.; Hitachi Cable, Ltd., both of Japan

[21] Appl. No.: 913,823

[22] Filed: Jun. 8, 1978

Related U.S. Application Data

[62] Division of Ser. No. 647,787, Jan. 9, 1976, abandoned.

[30] Foreign Application Priority Data

Jan. 13, 1975 [JP] Japan ..... 50-5626
Sep. 22, 1975 [JP] Japan ..... 50-114479

[51] Int. Cl.[2] ..... B21D 53/06

[52] U.S. Cl. ..... 72/325; 72/71; 29/157.3 A; 165/133

[58] Field of Search ..... 29/157.3 R, 157.3 A, 29/157.3 AH, 157.3 B; 165/133; 72/325, 71

[56] References Cited

U.S. PATENT DOCUMENTS

| | | | |
|---|---|---|---|
| 3,602,027 | 8/1971 | Klug et al. | 29/157.3 AH |
| 3,753,364 | 8/1973 | Runyan et al. | 29/157.3 AH |
| 3,881,342 | 5/1975 | Thorne | 29/157.3 AH |
| 3,906,604 | 9/1975 | Kakizaki et al. | 29/157.3 A |
| 4,040,479 | 8/1977 | Campbell et al. | 165/133 |

*Primary Examiner*—Lowell A. Larson
*Attorney, Agent, or Firm*—Craig and Antonelli

[57] ABSTRACT

A method of manufacturing a heat-transfer wall for vapor condensation comprising the step of forming on the heat-transfer surface, a number of shallow grooves substantially in parallel at a fine pitch, and then forming, on the heat-transfer surface and in the direction across said shallow grooves, a number of grooves deeper than the shallow grooves at a fine pitch by cutting and turning up the heat-transfer surface in the plowing manner. Said method may further comprise a subsequent step of curling the edges of the ridges formed in the above-mentioned step into said deep grooves.

8 Claims, 4 Drawing Figures

METHOD OF MANUFACTURING HEAT-TRANSFER WALL FOR VAPOR CONDENSATION

CROSS REFERENCE TO RELATED APPLICATION

This application is a divisional application of application Ser. No. 647,787 filed Jan. 9, 1976, now abandoned.

This invention relates to a method of manufacturing a heat-transfer wall having a heat-transmitting surface kept at a low temperature so that hot vapor brought into contact with the surface condenses thereon.

Heat-transfer walls conventionally in use for condensation purposes, for example the condenser tubes for turbo-refrigerators as components of large air conditioning units, are those provided with either smooth surfaces or "low-finned" surfaces, the latter being so called because the surfaces are integrally formed with relatively low fins. On a smooth heat-transfer surface the vapor initially condenses and forms drops but, with the progress of condensation, the entire surface will be covered by a mass of liquid drops, or a thick film of the liquid, which in turn will provide a thermal resistance and thereby reduce the efficiency of the heat-transfer surface. On the other hand, the low-finned surfaces preclude the formation of such thick liquid films but they are still unsatisfactory in respect of the heat transmission efficiency. In addition, the latter fails to follow the recent trend in the art toward smaller and lighter units.

It is therefore the object of the present invention to solve the above-mentioned problems and provide an improved heat-transfer wall having excellent condensation characteristics.

The object is realized, in accordance with the invention, by forming grooves at a fine pitch and thin, sharply tapering ridges defined and separated by the grooves, with fine-pitch notches shallower than the grooves made in the edges of the ridges, on the heat-transfer surface of plates and tubes constituting a heat-transfer wall for condensation. The grooves have a depth of not more than about 2 mm, preferably between 0.5 and 2.0 mm, and are arranged at a fine pitch of not more than 1 mm, preferably between 0.3 and 1.0 mm. Accordingly, the notches formed in the thin ridges separated by the grooves may be at a pitch generally same as that of the grooves.

The heat-transfer surface of the profile described can be easily obtained by first forming shallow grooves at a fine pitch on the surface of a heat-transfer wall, and then forming fine-pitch, deeper grooves across the said shallow grooves by cutting and turning up the grooved surface in a plowing manner. Thus, the method of forming such a heat-transfer surface is a feature of this invention. The machining by which the surface of a heat-transfer wall is not removed at all but is merely deformed, or the cutting as if by plowing, will produce inclined cuts. As a result, the grooves are deeper than the depth of cut by the cutting tools used, and hence the ridges are thin-walled. It is therefore extremely easy to form the grooves at a minimum pitch as mentioned above. The thin edges of the ridges defined between the grooves are sharply tapered, with a fragment of the original surface so cut and turned up constituting one flank of each ridge.

If the cutting of such grooves on the surface of a heat-transfer wall is preceded by the formation of the shallower grooves at a fine pitch on the same surface, the subsequent grooving across the shallow grooves in a plowing manner will sever the shallow ones into separate notches in the resulting ridges. This procedure provides utmost ease as compared with the usual method of forming deep grooves first and then making depressions corresponding to notches in the ridges defined by the grooves. The notches thus formed in accordance with the invention are also inclined to facilitate the flow of liquid drops and films of the condensate.

The shallow grooves that subsequently provide the notches may be formed by cutting or rolling in the usual manner.

The above and other objects, features and advantages of the invention will become more apparent from the following description when read in conjunction with the accompanying drawings showing preferred embodiments thereof. In the drawings.

Figure 1:
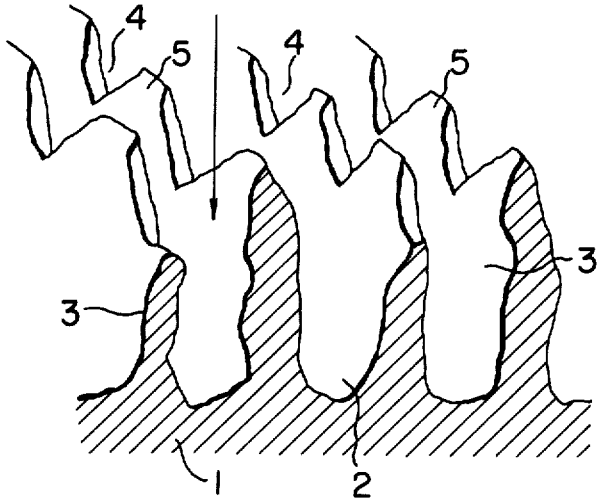
FIG. 1 is an enlarged sectional view of the outer surface of a copper tube embodying the invention.

Referring to FIG. 1, there is shown a fragment of a copper tube 1 constituting a heat-transfer wall having grooves 2 formed at a closed pitch on the outer surface of the tube 1, the grooves 2 defining ridges 3 in an alternate arrangement. The edge of each ridge 3 has shallower, fine-pitch "V" notches 4, whereby separate peaks 5 are formed on the crest. An arrow in the Figure indicates the direction of heat flow.

A copper tube with the surface structure described can be obtained by knurling the tube surface and subsequently machining thus knurled surface as if by plowing to form successive ridges.

Knurling is done by setting a knurling tool, which has a plurality of rolls with helical knurling ridges, on the tool rest of a lathe, forcing the rolls of the tool against the surface of a copper tube rotating with a chuck, and having the tool rest moved along a lead screw. In this way a helically continuous root, or shallow grooves, V-shaped in cross section, are formed on the workpiece at a fine pitch.

The grooved workpiece is then machined crosswise in a plowing manner. Several cutting tools, regularly shifted in phase, are clamped in a tool rest and are urged against the rotating work surface in the direction across the shallow grooves formed by knurling, for example at an angle of 45° to the grooves, in the same manner as in cutting a multiple start screw. This cutting produces a helically continuous root, or deep grooves 2 at a fine pitch and correspondingly raised ridges 3 of a thin wall. Since the ridges 3 are formed by cutting and turning up the copper tube surface obliquely in a plowing manner by means of cutting tools, they retain the original surface of the tube on one flanks and taper sharply toward the edges. As a result, the ridges are over the premachined surface of the tube and the depth of the grooves after the machining is greater than the depth of cutting by the tools. The cutting as if by a plow severs the shallow grooves previously formed by knurling into a multiplicity of notches 4 on the edges of the ridges, the bottom of each notch being inclined like the one flank of each ridge 3.

When the heat-transfer tube with the construction described is horizontally held and used for condensation, the liquid drops or a film formed by the liquid drops combined upon condensation of vapor on the upper part of each tube with the sharply tapered peaks 5, will flow into the grooves 2 or notches 4 under the actions of gravity and the surface tension of the condensate. The film over the peaks will then be thinned out and vigorous condensation of vapor will take place there.

Fine streams of the condensate in the grooves 2 are brought together and guided downward by gravity, and the liquid is rapidly released in the form of drops from the peaks 5.

The notches 4 in the edges of the ridges 3 share in and promote the accuracy of the actions above described, and maintain a thin liquid film over the entire heat-transfer wall surface for an improved heat transmission efficiency.

In accordance with the present invention, the heat-transfer wall 1 is not limited to that of tubes but may be the flat surface of plates or boards, in which case the notches 4 serve to disperse a condensate of poor flowability from grooves 2 where it is collected to adjacent grooves so that the liquid film over the flat heat-transfer surface is thinned out.

Figure 2:
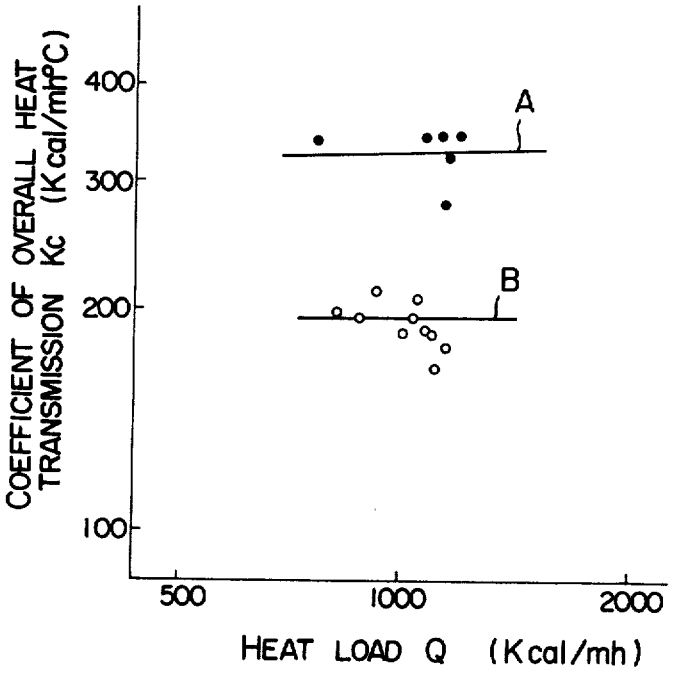
FIG. 2 is a graph showing the relationship between the heat load and the coefficient of overall heat transmission of a condenser tube incorporating the invention and of a conventional-low-finned tube.

FIG. 2 graphically represents the results of experiments conducted to demonstrate the advantageous effects of the present invention. Tubes incorporating the heat-transfer wall of the invention and those provided with the conventional low-finned wall were installed in shell-and-tube condensers of 300-refrigeration-ton turbo-refrigerators, and the condensation capacities of the test condensers (both using Freon R-11 as the refrigerant) were compared.

The heat-load Q (in Kcal/m.h.) is plotted as abscissa and the coefficient of overall heat transmission Kc (in Kcal/m.h.°C.) as ordinate.

In this graph the line A summarizes the results with heat-transfer tubes of copper according to the invention, measuring 19.2 mm in outside diameter, 0.4 mm in groove pitch, 0.8 mm in groove depth (the grooves extending at right angles to the axis of the tube), 0.2 mm in notch pitch, and 0.5 mm in notch depth. The line B summarizes the results with low-finned copper tubes 18.6 mm in outside diameter, 1.4 mm in fin pitch, and 1.3 mm in fin height. As can be seen from the graph, the coefficient of overall heat transmission achieved by the low-finned heat-transfer tubes was approximately 200 Kcal/m.h.°C. whereas that attained by the tubes according to the invention was over 300 Kcal/m.h.°C., indicating that the latter can achieve by far the higher heat transmission efficiency.

Figure 3:
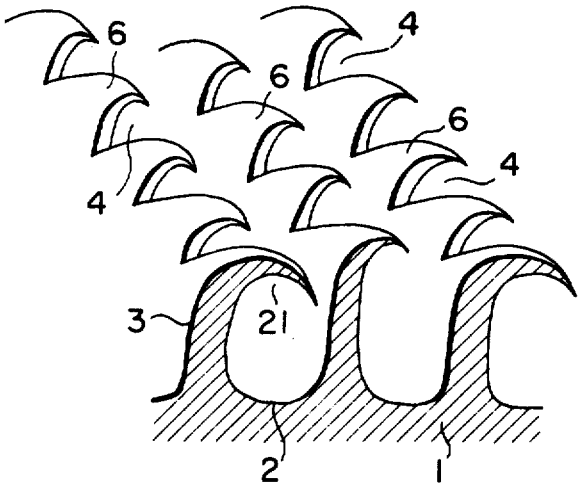
FIG. 3 is an enlarged sectional view of another embodiment of the invention.
Figure 4:
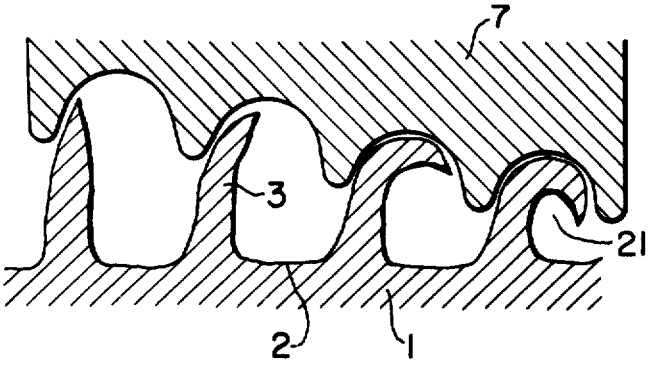
FIG. 4 is an enlarged sectional view of a heat-transfer wall and a die for producing the surface contour as shown in FIG. 3.

Another embodiment shown in FIG. 3 differs from the first one of FIG. 1 in that the peaks 5 at the edges of the ridges 3 are bent toward the grooves 2. A heat-transfer wall with such a surface contour is obtained by deforming their ridges 3 shown in FIG. 1 by means of a die 7 grooved as in FIG. 4. Bending of the ridges 3 by the deformation leaves the notches 4 partly behind thereon as slits communicated with hollows 21 in the rounded crests 6 that result.

In the condensation of vapor on this heat-transfer wall, the liquid drops or films composed of those drops formed on the rounded crests 6 flow mostly into the grooves 2 and hollows 21 under the urgings of gravity and surface tension of the condensate. The remaining liquid films that flow along the rounded crests 6 are led along the edges of the slits 4 into the grooves 2 via the hollows 21. Consequent thinning of the liquid films over the rounded crests 6 permits brisk vapor condensation with an increased heat transmission efficiency.

If the heat-transfer wall is that of a tube, part of the condensate flowing downward will gather in the hollows 21 generally U-shaped in the lower part of the tube. Then, the slits or deformed notches 4 in the ridges 3 that constitute the hollows 21 will allow the liquid to fall therethrough out of the hollows, so that the liquid will join the condensate portions from the adjacent parts of the tube and will rapidly leave the tube in the form of drops.

As has been stated above, this invention makes it possible to reduce the sizes of condensers for refrigerators, air conditioners and the like, improve their heat transmission efficiencies, and save the material cost considerably to great industrial advantages.

While the present invention has been described as embodied in the outer surfaces of condenser tubes, it should be obvious to those skilled in the art that the invention is applicable to the inner surfaces as well, for example of heat pipes and the like.

We claim:

1. A method of manufacturing a heat-transfer wall for vapor condensation in such a way that hot vapor is condensed by contact with the wall surface at a low temperature, the method comprising the steps of:

(a) forming, on the heat-transfer surface, a number of shallow grooves substantially in parallel at a pitch of not more than one millimeter between the grooves; and (b) forming, on the heat-transfer surface and in the direction across said shallow grooves formed in the step (a), a number of grooves not more than two millimeters in depth and deeper than the grooves formed in the step (a) and also forming ridges severed by said deep grooves and not more than two millimeters in depth as measured from the bottoms of said deep grooves, each said ridge having a sharply tapered edge and a number of notches with sharp, tapering edges and inclined bottoms, by cutting and turning up the heat-transfer surface in the plowing manner, or by cutting at an angle to the surface to turn up the material upright, through the relative movement of said heat-transfer surface and/or the plowing tool across said shallow grooves.

2. A method according to claim 1, wherein the shallow grooves formed in the step (a) and the deep grooves formed in the step (b) intersect at an angle of about 45°.

3. A method according to claim 1, wherein said shallow grooves are formed in the step (a) by knurling.

4. A method according to claim 1, wherein said shallow grooves are formed in the step (a) by a cutting tool.

5. A method according to claim 1, wherein said deep grooves and ridges are formed in the step (b) by a plurality of cutting tools.

6. A method according to claim 1, which further comprises in addition to the steps (a) and (b), a subsequent step (c) of curling the edges of the ridges formed in the step (b) toward and into said deep grooves while leaving the roots of said ridges upright relative to said heat-transfer surface, so that only the edges of the ridges are bent down.

7. A method according to claim 6, wherein said edges of said ridges are curled toward and into said deep grooves by means of a die having corresponding grooves.

8. A method of manufacturing a heat-transfer wall for vapor condensation whereby hot vapor contacting a heat-transfer surface of the heat-transfer wall is condensed at a low temperature, the method comprising the steps of:

(a) knurling, on the heat-transfer surface, a number of shallow, V-shaped grooves substantially in parallel to each other at a pitch of not more than one millimeter between the grooves;

(b) cutting and turning up the grooved heat-transfer surface, thereby deforming the surface to form a plurality of grooves deeper than the shallow grooves in a direction across the shallow grooves, that is about 45° to the shallow grooves, to form raised ridges between said deep grooves each having a sharply tapering edge and to sever the shallow grooves into a multiplicity of notches located on the tapering edges of the ridges; the deep grooves and the raised ridges being not more than two millimeters in depth and said notches having sharp tapering edges and inclined bottom portions.

* * * * *